US009476110B2

(12) United States Patent
Hattendorf et al.

(10) Patent No.: US 9,476,110 B2
(45) Date of Patent: Oct. 25, 2016

(54) NICKEL—CHROMIUM—IRON—ALUMINUM ALLOY HAVING GOOD PROCESSABILITY

(75) Inventors: Heike Hattendorf, Werdohl (DE); Jutta Kloewer, Duesseldorf (DE)

(73) Assignee: VDM Metals International GmbH, Werdohl (DE)

( * ) Notice: Subject to any disclaimer, the term of this patent is extended or adjusted under 35 U.S.C. 154(b) by 460 days.

(21) Appl. No.: 13/985,359

(22) PCT Filed: Feb. 17, 2012

(86) PCT No.: PCT/DE2012/000153

§ 371 (c)(1),
(2), (4) Date: Aug. 14, 2013

(87) PCT Pub. No.: WO2012/113373

PCT Pub. Date: Aug. 30, 2012

(65) Prior Publication Data

US 2013/0323113 A1 Dec. 5, 2013

(30) Foreign Application Priority Data

Feb. 23, 2011 (DE) ..... 10 2011 012 210
Feb. 10, 2012 (DE) ..... 10 2012 002 514

(51) Int. Cl.
*C22C 19/05* (2006.01)
*C22F 1/10* (2006.01)

(52) U.S. Cl.
CPC ..... *C22C 19/058* (2013.01); *C22C 19/05* (2013.01); *C22C 19/055* (2013.01); *C22C 19/056* (2013.01); *C22F 1/10* (2013.01)

(58) Field of Classification Search
CPC ..... C22C 19/055; C22C 19/056
See application file for complete search history.

(56) References Cited

U.S. PATENT DOCUMENTS

| | | | | |
|---|---|---|---|---|
| 4,784,830 | A | 11/1988 | Ganesan et al. | |
| 5,755,897 | A | 5/1998 | Brill | |
| 5,980,821 | A | 11/1999 | Brill | |
| 6,458,318 | B1 | 10/2002 | Nishiyama et al. | |
| 6,761,854 | B1 | 7/2004 | Smith et al. | |
| 6,852,177 | B2 | 2/2005 | Kubota et al. | |
| 2010/0166594 | A1* | 7/2010 | Hirata et al. | 420/443 |

FOREIGN PATENT DOCUMENTS

| | | | | |
|---|---|---|---|---|
| CA | 1 304 608 | C | 7/1992 | |
| CN | 1147560 | A | 4/1997 | |
| DE | 600 04 737 | T2 | 6/2004 | |
| EP | 0 508 058 | A1 | 10/1992 | |
| EP | 0 549 286 | * | 6/1993 | C22C 19/055 |
| EP | 0 549 286 | A1 | 6/1993 | |
| EP | 0 752 481 | A1 | 1/1997 | |
| JP | 63-026321 | A | 2/1988 | |
| JP | 63-312940 | A | 12/1988 | |
| JP | 07-050168 | A | 2/1995 | |
| JP | 07-114928 | A | 5/1995 | |
| JP | 2001-040443 | A | 2/2001 | |
| JP | 2002-180169 | A | 6/2002 | |
| JP | 2002-524658 | A | 8/2002 | |
| JP | 2003-247039 | A | 9/2003 | |
| KR | 2001-0007520 | A | 1/2001 | |

OTHER PUBLICATIONS

ThyssenKrupp VDM, Nicrofer 6025 HT—alloy 602 CA, Material Data Sheet No. 4037, Mar. 2007 Edition.
International Search Report of PCT/DE2012/000153, date of mailing Aug. 17, 2012.
Din En ISO 6892-1, Metallic materials—Tensile testing—Part 1: Method of test at room temperature, First edition Aug. 15, 2009, 72 pages.
Din En ISO 6892-2, Metallic materials—Tensile testing—Part 2: method of test at elevated temperature, May 2011, pp. 1-24.
DVS Bulletin 1004-1, Heißrißprüfverfahren Grundlagen, Nov. 1996, pp. 1-4.
DVS Bulletin 1004-2, Heißrißprüfverfahren mit fremdbeanspruchten Proben, Nov. 1996, pp. 1-8.

* cited by examiner

*Primary Examiner* — Jessee Roe
(74) *Attorney, Agent, or Firm* — Collard & Roe, P.C.

(57) ABSTRACT

The invention relates to a nickel-chromium-aluminum-iron alloy, comprising (in wt %) 12 to 28% chromium, 1.8 to 3.0% aluminum, 1.0 to 15% iron, 0.01 to 0.5% silicon, 0.005 to 0.5% manganese, 0.01 to 0.20% yttrium, 0.02 to 0.60% titanium, 0.01 to 0.2% zirconium, 0.0002 to 0.05% magnesium, 0.0001 to 0.05% calcium, 0.03 to 0.11% carbon, 0.003 to 0.05% nitrogen, 0.0005 to 0.008% boron, 0.0001 to 0.010% oxygen, 0.001 to 0.030% phosphorus, max. 0.010% sulfur, max. 0.5% molybdenum, max. 0.5% tungsten, the remainder nickel and the common contaminants resulting from the process, wherein the following relations must be satisfied: $7.7C-x\cdot a<1.0$, wherein $a=PN$ if $PN>0$ or $a=0$ if $PN\leq 0$. Here, $x=(1.0\ Ti+1.06\ Zr)/(0.251\ Ti+0.132\ Zr)$, $PN=0.251\ Ti+0.132\ Zr-0.857\ N$, and Ti, Zr, N, and C are the concentration of the respective element in mass percent.

20 Claims, 1 Drawing Sheet

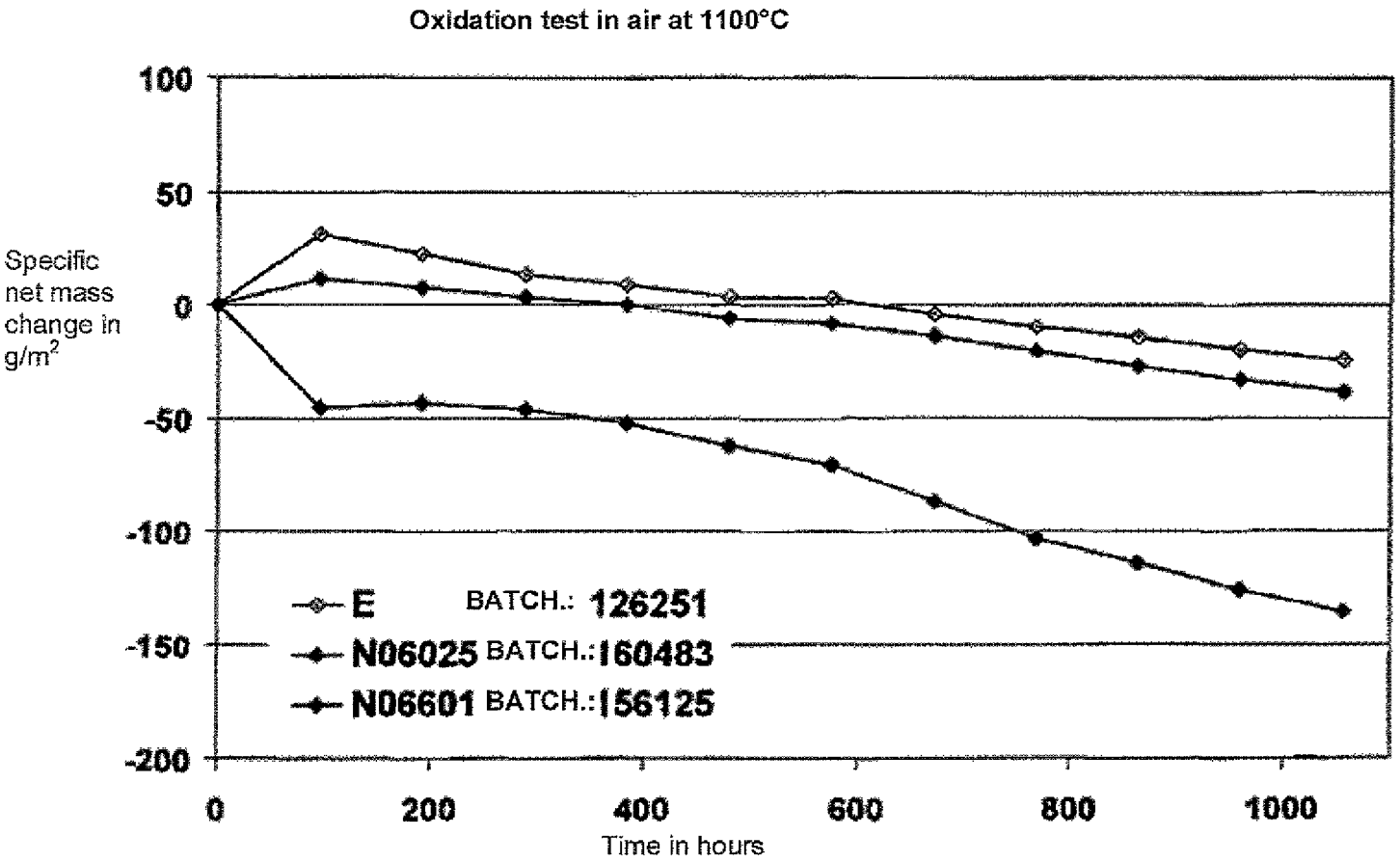
Results of the oxidation experiment at 1100°C in air.

NICKEL—CHROMIUM—IRON—ALUMINUM ALLOY HAVING GOOD PROCESSABILITY

CROSS REFERENCE TO RELATED APPLICATIONS

This application is the National Stage of PCT/DE2012/000153 filed on Feb. 17, 2012, which claims priority under 35 U.S.C. §119 of German Application Nos. 10 2011 012 210.9 filed on Feb. 23, 2011 and 10 2012 002 514.9 filed on Feb. 10, 2012, the disclosures of which are incorporated by reference. The international application under PCT article 21(2) was not published in English.

BACKGROUND OF THE INVENTION

1. Field of the Invention

The invention relates to a nickel-chromium-iron-aluminum alloy having excellent high-temperature corrosion resistance, good creep resistance, and improved processability.

2. Description of the Related Art

Austenitic nickel-chromium-iron-aluminum alloys having different nickel, chromium, and aluminum contents have been used in furnace construction and in the chemical process industry for a long time. For this use, good high-temperature corrosion resistance and good heat resistance/creep resistance even at temperatures above 1000° C. is required.

In general, it should be noted that the high-temperature corrosion resistance of the alloys indicated in Table 1 increases with an increasing chromium content. All of these alloys form a chromium oxide layer ($Cr_2O_3$) with an $Al_2O_3$ layer that lies underneath and is more or less closed. Slight additions of strongly oxygen-affine elements such as Y or Ce, for example, improve the oxidation resistance. The chromium content is slowly consumed during the course of use in the region of application, to build up the protective layer. For this reason, the useful lifetime of the material is increased by means of a higher chromium content, because a higher content of chromium, as the element that forms the protective layer, delays the point in time at which the Cr content is below the critical limit and oxides other than $Cr_2O_3$ form, which are oxides that contain iron or that contain nickel, for example. A further increase in the high-temperature corrosion resistance can be achieved by means of addition of aluminum and silicon. Starting from a certain minimum content, these elements form a closed layer below the chromium oxide layer, and thereby reduce the consumption of chromium.

The heat resistance/creep resistance at the temperatures indicated is improved by means of a higher carbon content, among other things.

Examples of these alloys are listed in Table 1.

Alloys such as N06025, N06693 or N06603 are known for their excellent corrosion resistance in comparison with N06600, N06601 or N06690, because of the high aluminum content. Alloys such as N06025 or N06603 also demonstrate excellent heat resistance/creep resistance even at temperatures above 1000° C., because of the high carbon content. However, the processability, e.g. formability and weldability, are impaired by these high aluminum content values, whereby the impairment is all the greater, the higher the aluminum content (N06693). The same holds true to an increased degree for silicon, which forms intermetallic phases with nickel that melt at a low temperature. For N06025, for example, it was possible to achieve weldability by means of the use of a special welding gas (Ar with 2% nitrogen) (data sheet for Nicrofer 6025 HT, ThyssenKrupp VDM). The high carbon content in N06025 and N06603 results in a high content of primary carbides, which leads to crack formation, proceeding from the primary carbides, for example at high degrees of forming, as they occur during deep drawing, for example. Something similar happens during the production of seamless pipes. Here, too, the problem becomes worse with an increasing carbon content, particularly in the case of N06025.

EP 0 508 058 A1 discloses an austenitic nickel-chromium-iron alloy consisting of (in weight-%) C 0.12-0.3%, Cr 23-30%, Fe 8-11%, Al 1.8-2.4%, Y 0.01-0.15%, Ti 0.01-1.0%, Nb 0.01-1.0%, Zr 0.01-0.2%, Mg 0.001-0.015%, Ca 0.001-0.01%, N max. 0.03%, Si max. 0.5%, Mn max. 0.25%, P max. 0.02%, S max. 0.01%, Ni remainder, including unavoidable melting-related contaminants.

EP 0 549 286 discloses a high-temperature-resistant Ni—Cr alloy containing 55-65% Ni, 19-25% Cr, 1-4.5% Al, 0.045-0.3% Y, 0.15-1% Ti, 0.005-0.5% C, 0.1-1.5% Si, 0-1% Mn, and at least 0.005% in total of at least one of the elements of the group that contains Mg, Ca, Ce, <0.5% in total Mg+Ca, <1% Ce, 0.0001-0.1% B, 0-0.5% Zr, 0.0001-0.2% N, 0-10% Co, remainder iron and contaminants.

From DE 600 04 737 T2, a heat-resistant nickel-based alloy has become known, containing ≤0.1% C, 0.01-2% Si, ≤2% Mn, ≤0.005% S, 10-25% Cr, 2.1-<4.5% Al, ≤0.055% N, in total 0.001-1% of at least one of the elements B, Zr, Hf, whereby the stated elements can be present in the following contents: B≤0.03%, Zr≤0.2%, Hf≤0.8%. Mo 0.01-15%, W 0.01-9%, whereby a total content Mo+W of 2.5-15% can exist, Ti 0-3%, Mg 0-0.01%, Ca 0-0.01%, Fe 0-10%, Nb 0-1%, V 0-1%, Y 0-0.1%, La 0-0.1%, Ce 0-0.01%, Nd 0-0.1%, Cu 0-5%, Co 0-5%, remainder nickel. For Mo and W, the following formula must be fulfilled:

$$2.5 \leq Mo+W \leq 15 \quad (1)$$

SUMMARY OF THE INVENTION

The task on which the invention is based consists in designing an alloy, which, at sufficiently high nickel, chromium, and aluminum contents,

- demonstrates good processability, i.e. formability, deep drawing ability, and weldability,
- demonstrates good corrosion resistance similar to N06025,
- demonstrates good heat resistance/creep resistance.

This task is accomplished by means of a nickel-chromium-aluminum-iron alloy having (in wt.-%) 12 to 28% chromium, 1.8 to 3.0% aluminum, 1.0 to 15% iron, 0.01 to 0.5% silicon, 0.005 to 0.5% manganese, 0.01 to 0.20% yttrium, 0.02 to 0.60% titanium, 0.01 to 0.2% zirconium, 0.0002 to 0.05% magnesium, 0.0001 to 0.05% calcium, 0.03 to 0.11% carbon, 0.003 to 0.05% nitrogen, 0.0005 to 0.008% boron, 0.0001-0.010% oxygen, 0.001 to 0.030% phosphorus, max. 0.010% sulfur, max. 0.5% molybdenum, max. 0.5% tungsten, remainder nickel and the usual process-related contaminants, wherein the following relationships must be fulfilled:

$$0 < 7.7C - x \cdot a < 1.0 \quad (2)$$

$$\text{with } a = PN, \text{ if } PN > 0 \quad (3a)$$

$$\text{or } a = 0, \text{ if } PN \leq 0 \quad (3b)$$

$$\text{and } x = (1.0Ti + 1.06Zr)/(0.251Ti + 0.132Zr) \quad (3c)$$

$$\text{where } PN = 0.251Ti + 0.132Zr - 0.857N \quad (4)$$

and Ti, Zr, N, C are the concentration of the related elements in mass-%.

Advantageous further developments of the object of the invention can be derived from the related dependent claims.

BRIEF DESCRIPTION OF THE DRAWINGS

FIG. 1 shows results of an oxidation test at 1100° C. in air.

DETAILED DESCRIPTION OF THE PREFERRED EMBODIMENTS

The spread range for the element chromium lies between 12 and 28%, whereby chromium contents can exist as follows as a function of the case of use, and are adjusted in the alloy as a function of the case of use.

Preferred ranges are reproduced as follows:

16 to 28%

20 to 28%

>24 to 27%

19 to 24%

The aluminum content lies between 1.8 and 3.0%, whereby here, too, depending on the region of use of the alloy, aluminum contents can exist as follows:

1.9 to 2.9%

1.9 to 2.5%

>2.0 to 2.5%

The iron content lies between 1.0 and 15%, whereby, depending on the region of use, defined contents within the spread range can be adjusted:

1.0-11.0%

1.0-7.0%

7.0-11.0%

The silicon content lies between 0.01 and 0.50%. Preferably, Si can be adjusted in the alloy within the spread region as follows:

0.01-0.20%

0.01-<0.10%

The same holds true for the element manganese, which can be contained in the alloy at 0.005 to 0.5%. Alternatively, the following spread range is also possible:

0.005-0.20%

0.005-0.10%

0.005-<0.05%

The object of the invention preferably proceeds from the assumption that the material properties can essentially be adjusted with the addition of the element yttrium in contents of 0.01 to 0.20%. Preferably, Y can be adjusted in the alloy as follows, within the spread range:

0.01-0.15%

0.02-0.15%

0.01-0.10%

0.02-0.10%

0.01-<0.045%.

Optionally, yttrium can also be replaced, completely or partially, by 0.001-0.20% lanthanum and/or 0.001-0.20% cerium.

Preferably, the substitute, in each instance, can be adjusted in the alloy as follows, within its spread range:

0.001-0.15%.

The titanium content lies between 0.02 and 0.60%. Preferably, Ti can be adjusted in the alloy as follows, within its spread range:

0.03-0.30%, 0.03-0.20%.

Optionally, titanium can be completely or partially replaced by 0.001 to 0.60% niobium.

Preferably, the substitute can be adjusted in the alloy as follows, within the spread range:

0.001% to 0.30%.

Optionally, titanium can also be completely or partially replaced by 0.001 to 0.60% tantalum.

Preferably, the substitute can be adjusted in the alloy as follows, within the spread range:

0.001% to 0.30%.

The zirconium content lies between 0.01 and 0.20%. Preferably, Zr can be adjusted in the alloy as follows, within the spread range:

0.01-0.15%.

0.01-0.08%.

0.01-0.06%.

Optionally, zirconium can also be completely or partially replaced by 0.001-0.2% hafnium.

Magnesium is also contained in contents of 0.0002 to 0.05%. Preferably, the possibility exists of adjusting this element in the alloy as follows:

0.0005-0.03%.

The alloy furthermore contains calcium in contents between 0.0001 and 0.05%, particularly 0.0005 to 0.02%.

The alloy contains 0.03 to 0.11% carbon. Preferably, this can be adjusted in the alloy as follows, within the spread range:

0.04-0.10%.

This applies in equal manner for the element nitrogen, which is contained in contents between 0.003 and 0.05%. Preferred contents can exist as follows:

0.005-0.04%.

The elements boron and oxygen are contained in the alloy as follows:

boron 0.0005-0.008% oxygen 0.0001-0.010%.

Preferred contents can exist as follows:

boron 0.0015-0.008%

The alloy furthermore contains phosphorus in contents between 0.001 and 0.030%, and particularly contains 0.002 to 0.020%.

The element sulfur can exist in the alloy as follows:

sulfur max. 0.010%

Molybdenum and tungsten can be contained in the alloy, individually or in combination, with a content of maximally 0.50%, in each instance. Preferred contents can exist as follows:

Mo max. 0.20%

W max. 0.20%

Mo max. 0.10%

W max. 0.10%

Mo max. 0.05%

W max. 0.05%

The following relationships, which describe the interactions between Ti, Zr, N, and C, must be fulfilled:

$$0<7.7C-x\cdot a<1.0 \quad (2)$$

$$\text{with } a=PN, \text{ if } PN>0 \quad (3a)$$

$$\text{or } a=0, \text{ if } PN\leq 0 \quad (3b)$$

$$\text{and } x=(1.0Ti+1.06Zr)/(0.251*Ti+0.132Zr) \quad (3c)$$

$$\text{where } PN=0.251Ti+0.132Zr-0.857N \quad (4)$$

and Ti, Zr, N, C are the concentration of the related elements in mass-%.

A preferred range can be adjusted at:

$$0<<7.7C-x\cdot a<0.90 \quad (2a)$$

If Zr is completely or partially substituted by Hf, the formulas 3c and 4 should be changed as follows:

$$x=(1.0Ti+1.06Zr+0.605Hf)/(0.251*Ti+0.132Zr+0.0672Hf) \quad (3c\text{-}1)$$

$$\text{where } PN=0.251Ti+0.132Zr+0.0672Hf-0.857N \quad (4\text{-}1)$$

and Ti, Zr, Hf, N, C are the concentration of the elements in question in mass-%.

Furthermore, the alloy can contain between 0.01 to 5.0% cobalt, which furthermore can also be restricted as follows:

0.01 to 2.0%

0.1 to 2.0%

0.01 to 0.5%.

Furthermore, maximally 0.1% vanadium can be contained in the alloy.

Finally, the elements copper, lead, zinc, and tin can also exist as contaminants, in contents as follows:

Cu max. 0.50%

Pb max. 0.002%

Zn max. 0.002%

Sn max. 0.002%.

The content of copper can furthermore be restricted as follows:

Cu less than 0.015%

The alloy according to the invention is preferably melted in open manner, followed by treatment in a VOD or VLF system. After being cast in blocks or as an extrusion, the alloy is hot-formed to the desired semi-finished product form, if necessary with intermediate annealing between 900° C. and 1270° C. for 2 h to 70 h. The surface of the material can be removed chemically and/or mechanically, if necessary (also multiple times) in between and/or at the end of cleaning. After the end of hot-forming, cold-forming can take place, if necessary, with forming degrees of up to 98%, to the desired semi-finished product form, if necessary with intermediate annealing between 800° C. and 1250° C. for 0.1 min to 70 h, if necessary under protective gas, such as argon or hydrogen, for example, followed by cooling in air, in the moved annealing atmosphere or in a water bath. Afterward, annealing in a temperature range of 800° C. to 1250° C. takes place for 0.1 min to 70 h, if necessary under protective gas, such as argon or hydrogen, for example, followed by cooling in air, in the moved annealing atmosphere, or in a water bath. If necessary, chemical and/or mechanical cleaning processes of the material surface can take place in between.

The alloy according to the invention can be produced and used well in the product forms of strip, sheet, rod, wire, pipe welded with a longitudinal seam, and seamless pipe.

The alloy according to the invention should preferably be used for use in furnace construction, for example as muffles for annealing furnaces, furnace rollers, or support frames.

A further area of application is use as a pipe in the petrochemical industry or in solar thermal power plants.

Likewise, the alloy can be used as a mantle in glow plugs, as a catalytic converter support foil, and as a component in exhaust gas systems.

The alloy according to the invention is well suited for the production of deep-drawn parts.

Tests Conducted:

Formability is determined in a tensile test according to DIN EN ISO 6892-1 at room temperature. In this connection, the elongation limit $R_{p0.2}$, the tensile strength $R_m$, and the elongation A to rupture are determined. The elongation A is determined on the ruptured sample, from the lengthening of the original measurement segment $L_0$:

$$A=(L_U-L_0)/L_0 100\%=\Delta L/L_0 100\%$$

With $L_U$=measurement length after rupture.

Depending on the measurement length, the elongation to rupture is provided with indices:

For example, for $A_5$ the measurement length is $L_0=5\cdot d_0$ with $d_0$=initial diameter of a round sample The tests were conducted on round samples having a diameter of 6 mm in the measurement region and a measurement length $L_0$ of 30 mm. Sample-taking took place transverse to the forming direction of the semi-finished product. The forming speed was 10 MPA/s at $R_{p0.2}$, and 6.7 $10^{-3}$ 1/s (40%/min) at $R_m$.

The value of the elongation A in the tensile test at room temperature can be taken to be a measure of deformability. A material that has good processability should have an elongation of at least 50%.

Here, weldability is assessed by way of the extent of the formation of hot cracks (see DVS bulletin 1004-1). The greater the risk of the formation of hot cracks, the poorer the weldability of the material. The hot-crack susceptibility was tested using the Modified Varestraint Transvarestraint Test (MVT test), at the Federal Institute for Material Research and Testing (see DVS bulletin 1004-2). In an MVT test, a WIG seam is laid on the surface of a material sample having the dimensions 100 mm×40 mm×10 mm, lengthwise, in fully mechanized manner, at a constant advancing speed. When the arc passes the center of the sample, a defined bending elongation is applied to the sample, in that the sample is bent about a matrix having a known radius, by means of dies. In this phase of bending, hot cracks form on the MVT sample, in a locally limited test zone. For the measurements, the samples were bent lengthwise relative to the welding direction (Varestraint). Experiments were conducted with 1% and 4% bending elongation, a total speed of 2 mm/s, with a stretching energy of 7.5 kJ/cm, under argon 5.4 and argon with 3% nitrogen, in each instance. The hot-crack resistance is quantified as follows: The lengths of all the solidification and remelting cracks that are visible on the sample under a light microscope at 25× magnification are added up. In the same manner, the cracks are determined by means of a decrease in formability (DDC=Ductility Dip Cracks). Using these results, the material can then be classified in the categories "not at risk for hot cracks," "increasing tendency toward hot cracks," and "at risk for hot cracks."

| | Total length of solidification and remelting cracks in mm | | |
|---|---|---|---|
| At bending elongation | not at risk for hot cracks | increasing tendency toward hot cracks | at risk for hot cracks |
| 1% | ≤0 | ≤7.5 | >7.5 |
| 4% | ≤15 | ≤30 | >30 |

All the materials that lie in the range of "not at risk for hot cracks" and "increasing tendency toward hot cracks" in the MVT test are considered to be weldable in the following investigations.

Corrosion resistance at higher temperatures was determined in an oxidation test at 1100° C., in air, whereby the test was interrupted every 96 hours and the measurement changes of the sample resulting from oxidation were determined (net mass change $m_N$). The specific (net) mass change is the mass change with reference to the surface of the samples. Three samples of each batch were aged.

Heat resistance is determined in a hot tensile test according to DIN EN ISO 6892-2. In this connection, the elongation limit $R_{p0.2}$, the tensile strength $R_m$, and the elongation A to rupture are determined analogous to the tensile test, at room temperature (DIN EN ISO 6892-1).

The tests were conducted using round samples having a diameter of 6 mm in the measurement region, and an initial measurement length $L_0$ of 30 mm. Sample-taking took place transverse to the forming direction of the semi-finished product. The forming speed was 8.33 $10^{-5}$ 1/s (0.5%/min) at $R_{p0.2}$ and 8.33 $10^{-4}$ 1/s (5%/min) at $R_m$.

The sample is placed into a tensile testing machine at room temperature, and heated to the desired temperature without stress by a tensile force. After the test temperature has been reached, the sample is held without stress for one hour (600° C.) or two hours (700° C. to 1100° C.), respectively, for temperature equalization. Afterward, a tensile stress is placed on the sample so that the desired elongation speeds are maintained, and the test begins.

Creep resistance is determined by way of a slow tensile test (SSRT=Slow Strain Rate Test). For this purpose, a hot tensile test according to DIN EN ISO 6892-2 is conducted at very low forming speeds of $1.0\times10^{-6}$ 1/s. This elongation speed already lies in the range of creep speeds, so that a ranking of materials with reference to creep resistance can be carried out using a comparison of elongation limit and, in particular, tensile strength determined with the slow tensile test.

The elongation limit $R_{p0.2}$, the tensile strength $R_m$, and the elongation A to rupture are determined analogous to the method described for the tensile test at room temperature (DIN EN ISO 6892-1). To reduce the testing times, the tests were stopped after approximately 30% elongation, if $R_m$ has been reached, otherwise after the elongation A for $R_m$ was exceeded. The tests were conducted using round samples having a diameter of approximately 8 mm in the measurement region and a measurement length $L_0$ of 40 mm. Sample-taking took place transverse to the forming direction of the semi-finished product.

The sample is placed into a tensile testing machine at room temperature, and heated to the desired temperature without stress by a tensile force. After the test temperature has been reached, the sample is held without stress for two hours (700° C. to 1100° C.), for temperature equalization. Afterward, a tensile stress is placed on the sample so that the desired elongation speeds are maintained, and the test begins.

Examples:

Tables 2a and 2b show the composition of the alloys investigated.

The alloys N06025 and N06601 are alloys according to the state of the art. The alloy according to the invention is indicated with "E." The analyses of the alloys N06025 and N06601 lie in the ranges indicated in Table 1. The alloy "E" according to the invention has a C content that lies in the center between N06025 and N06601. In Table 2a, PN and 7.7 C−x·a according to Formulas 2 and 4 are furthermore indicated. PN is greater than zero for all the alloys in Table 2a. 7.7 C−x·a, at 0.424, lies precisely in the preferred range 0<7.7 C−x·a<1.0 for the alloy according to the invention.

For the alloy according to the state of the art, N06025, 7.7 C−x·a is greater than 1.0 and therefore too great.

For the alloy according to the state of the art, N06601, 7.7 C−x·a is less than zero and therefore too small.

For these example batches, the following properties are compared:

- deformability using the tensile test at room temperature
- weldability using the MVT test
- corrosion resistance using an oxidation test
- heat resistance with hot tensile tests
- creep resistance using a ranking of results from slow tensile tests.

Table 3 shows the results of the tensile test at room temperature. The alloy "E" according to the invention shows an elongation, at an elongation of over 80%, which is far greater than that of N06025 and N06601. This is not surprising for N06025, due to the high carbon content of 0.17% of the two example batches 163968 and 160483. Both batches show their poorer formability by an elongation less than 50%. For N06601, this is noteworthy, however, because the batches 314975 and 156656 have a carbon content of 0.045 and 0.053%, respectively, which is clearly lower then that of the alloy according to the invention, at 0.075%, and also, as expected, have an elongation greater than 50%. This shows that when the range for limits for 0<7.7 C−x·a<1.0 is adhered to, formability that goes beyond the state of the art is obtained.

Table 4 shows the results of the MVT tests. N06601 can be welded with both gases, argon and argon with 3% nitrogen, because all the measured total crack lengths for 1% bending elongation are less than 7.5 mm, and all the measured total crack lengths for 4% bending elongation are less than 30 mm. For N06025 and the alloy "E" according to the invention, the measured total crack lengths are greater than 7.5 mm (1% bending elongation) and 30 mm (4% bending elongation), respectively, so that these alloys cannot be welded with argon. For argon with 3% nitrogen, however, the measured total crack lengths clearly lie below 7.5 mm (1% bending elongation) and 30 mm (4% bending elongation), respectively, so that N06025 and the alloy "E" according to the invention can be welded with argon with 3% nitrogen.

FIG. 1 shows the results of the oxidation test at 1100° C. in air. The specific (net) mass change of the sample is plotted (average value of the 3 samples of each batch) as a function of the aging time. The N06601 batch demonstrates a negative specific mass change from the start, which is caused by severe flaking and evaporation of chromium oxide. In the case of N06025 and the alloy "E" according to the invention, a slight increase in the mass change is shown at the start, followed by a very moderate decrease over time. This shows that both alloys have a low oxidation rate and only very little flaking at 1100° C. The behavior of the alloy "E" according to the invention is comparable with that of N06025, as required.

Table 5 shows the results of the hot tensile tests at 600° C., 700° C., 800° C., 900° C., and 1100° C. The highest values both at $R_{p0.2}$ and at $R_m$ are shown by N06025, as expected, and the lowest by N06601. The values of the alloy "E" according to the invention lie in between, whereby at 800° C., the values of the alloy "E" according to the invention are greater than those of N06025 both at $R_{p0.2}$ and at $R_m$. The elongation values in the hot tensile tests are sufficiently great for all the alloys. At 1100° C., no differences can be found any longer between the alloy "E" according to the invention and N06601, due to the measurement accuracy.

Table 6 shows the results of the slow tensile tests at 700° C., 800° C., and 1100° C. The highest values both at $R_{p0.2}$ and at $R_m$ are shown, as expected, by N06025, and the lowest by N06601. The value of the alloy "E" according to the invention lie in between for $R_{p0.2}$; for $R_m$ at 700° C. and 800° C., they are better or almost as good as N06025. The elongations in the slow tensile tests are sufficiently great for all the alloys. At 1100° C., no differences can be found any longer between the alloy "E" according to the invention and N06601, due to the measurement accuracy.

At 700° C. and 800° C., $R_m$ from the slow tensile tests of N06025 and the alloy "E" according to the invention is comparable, i.e. it can be expected that at these temperatures, the creep resistance of N06025 and that of the alloy "E" according to the invention is comparable. This shows that for alloys in the preferred range $0<7.7\ C-x\cdot a<1.0\ R_m$, the creep resistance is comparable to that of Nicrofer 6025 HT, with simultaneously goad processability of the alloy "E" according to the invention in comparison with N06025.

The claimed limits for the alloy "E" according to the invention can therefore be explained as follows, in detail:

The costs for the alloy increase with a reduction in the iron content. Below 1%, the costs increase disproportionately, since a special pre-material has to be used. Therefore 1% Fe must be viewed as a lower limit for cost reasons.

With an increase in the iron content, the phase stability (formation of phases causing brittleness) is reduced, particularly at high chromium and aluminum contents. Therefore 15% Fe is a practical upper limit for the alloy according to the invention.

Overly low Cr contents means that the Cr concentration very quickly drops below the critical limit. Therefore 12% Cr is the lower limit for chromium. Overly high Cr contents worsen the processability of the alloy. Therefore 28% Cr must be viewed as an upper limit.

The formation of an aluminum oxide layer underneath the chromium oxide layer reduces the oxidation rate. Below 1.8% Al, the aluminum oxide layer contains too many gaps to fully develop its effect. Overly high Al contents impair the processability of the alloy. Therefore an Al content of 3.0% forms the upper limit.

Si is needed in the production of the alloy. Therefore a minimum content of 0.01% is required. Overly high contents in turn impair processability. The Si content is therefore limited to 0.5%.

A minimum content of 0.005% Mn is necessary to improve processability. Manganese is limited to 0.5%, because this element also reduces oxidation resistance.

As has already been mentioned, additions of oxygen-affine elements improve oxidation resistance. They do this in that they are installed into the oxide layer, and block the diffusion paths of the oxygen there, on the grain boundaries.

A minimum content of 0.01% Y is necessary to obtain the oxidation-resistance-increasing effect of Y. The upper limit is placed at 0.20% for cost reasons.

Y can be completely or partially replaced by Ce and/or La, because these elements also, like Y, increase oxidation resistance. Replacement is possible starting with contents of 0.001%. The upper limit is placed at 0.20% Ce or 0.20% La for cost reasons.

Titanium increases the high-temperature resistance. At least 0.02% is needed to achieve an effect. From 0.6%, the oxidation behavior is worsened.

Titanium can be completely or partially replaced by niobium, because niobium also increases the high-temperature resistance. Replacement is possible from 0.001%. Higher contents greatly increase the costs. The upper limit is therefore set at 0.6%.

Titanium can also be completely or partially replaced with tantalum, because tantalum also increases the high-temperature resistance. Replacement is possible from 0.001%. Higher contents very greatly increase the costs. The upper limit is therefore set at 0.6%.

A minimum content of 0.01% Zr is necessary to obtain the effect of Zr that increases high-temperature resistance and oxidation resistance. The upper limit is placed at 0.20% Zr for cost reasons.

Zr can be completely or partially replaced by Hf, if necessary, because this element also, like Zr, increases the high-temperature resistance and the oxidation resistance. Replacement is possible from contents of 0.001%. The upper limit is set at 0.20% Hf for cost reasons.

Even very low Mg contents improve processing, by means of binding of sulfur, thereby avoiding the occurrence of NiS eutectics with a low melting point. Therefore a minimum content of 0.0002% is required for Mg. At overly high contents, intermetallic Ni—Mg phases can occur, which again clearly worsen processability. The Mg content is therefore limited to 0.05%.

Just like Mg, even very low Ca contents already improve processing by means of binding of sulfur, thereby avoiding the occurrence of NiS eutectics having a low melting point. For Ca, a minimum content of 0.0001% is therefore required. At overly high contents, intermetallic Ni—Ca phases can occur, which again clearly worsen processability. The Ca content is therefore limited to 0.05%.

A minimum content of 0.03% C is required for good creep resistance. C is limited to 0.11%, because this element reduces processability.

A minimum content of 0.003% N is required, thereby improving the processability of the material. N is limited to 0.05%, because this element reduces oxidation resistance.

Boron improves creep resistance. Therefore a content of at least 0.0005% should be present. At the same time, this surfactant element worsens oxidation resistance. Therefore max. 0.008% boron is established.

The oxygen content must be less than 0.010% to guarantee producibility of the alloy. Overly small oxygen contents cause increased costs. The oxygen content should therefore be greater than 0.0001%.

The content of phosphorus should be less than 0.030%, because this surfactant element impairs oxidation resistance. An overly low P content increases costs. The P content is therefore ≥0.001%.

The contents of sulfur should be set as low as possible, because this surfactant element impairs oxidation resistance. Therefore max. 0.010% S is established.

Molybdenum is limited to max. 0.5%, because this element reduces oxidation resistance.

Tungsten is limited to max. 0.5%, because this element also reduces oxidation resistance.

The following formula describes the interaction of C, N, Ti, Zr, and in the alloy:

$$0<7.7C-x\cdot a<1.0 \quad (2)$$

$$\text{with } a=PN, \text{ if } PN>0 \quad (3a)$$

$$\text{or } a=0, \text{ if } PN\leq 0 \quad (3b)$$

$$\text{and } x=(1.0Ti+1.06Zr)/(0.251Ti+0.132Zr) \quad (3c)$$

$$PN=0.251Ti+0.132Zr-0.857N \quad (4)$$

and Ti, Zr, N, C are the concentration of the related elements in mass-%.

If 7.7 C−x·a is greater than 1.0, so many primary carbides are formed, which impair formability. If 7.7 C−x·a is less than 0, heat resistance and creep resistance worsen.

Cobalt can be contained in this alloy up to 5.0%. Higher contents markedly reduce the oxidation resistance. An overly low cobalt content increases costs. The Co content is therefore ≥0.01%.

Vanadium is limited to max. 0.1%, because this element reduces oxygen resistance.

Copper is limited to max. 0.5%, because this element reduces oxygen resistance.

Pb is limited to max. 0.002%, because this element reduces oxygen resistance. The same holds true for Zn and Sn.

TABLE 1

Alloys according to ASTM B 168-08. All information in mass-%

| Alloy | Ni | Cr | Co | Mo | Nb | Fe | Mn | Al | C | Cu |
|---|---|---|---|---|---|---|---|---|---|---|
| N06600 | 72.0 min | 14.0-17.0 | | | | 6.0-10.0 | 1.0 max | | 0.15 max | 0.5 max |
| N06601 | 58.0-63.0 | 21.0-26.0 | | | | R | 1.0 max | 1.0-1.7 | 0.10 max | 0.5 max |
| N06617 | 44.5 min | 20.0-24.0 | 10.0-15.0 | 8.0-10.0 | | 3.0 max | 1.0 max | 0.8-1.5 | 0.05-0.15 | 1.0 max |
| N06890 | 58.0 min | 27.0-31.0 | | | | 7.0-11.0 | 0.5 max | | 0.05 max | 0.5 max |
| N06693 | R | 27.0-31.0 | | | 0.5-2.5 | 2.5-6.0 | 1.0 max | 2.5-4.0 | 0.15 max | 0.5 max |
| N06025 | R | 24.0-25.0 | | | | 8.0-11.0 | 0.15 max | 1.8-2.4 | 0.16-0.25 | 0.1 max |
| N06045 | 45 min | 26.0-29.0 | | | | 21.0-25.0 | 1.0 max | | 0.05-0.12 | 0.3 max |
| N06603 | R | 24.0-26.0 | | | | 8.0-11.0 | 0.15 max | 2.4-3.0 | 0.20-0.40 | 0.50 max |
| N06696 | R | 28.0-32.0 | | 1.0-3.0 | | 2.0-6.0 | 1.0 max | | 0.15 max | 1.5-3.0 |

| Alloy | Si | S | Ti | P | Zr | Y | B | N | Ce |
|---|---|---|---|---|---|---|---|---|---|
| N06600 | 0.5 max | 0.015 max | | | | | | | |
| N06601 | 0.5 max | 0.015 max | | | | | | | |
| N06617 | 0.5 max | 0.015 max | 0.6 max | | | | 0.006 max | | |
| N06890 | 1.0 max | 0.015 max | | | | | | | |
| N06693 | 0.5 max | 0.01 max | 1.0 max | | | | | | |
| N06025 | 0.5 max | 0.010 max | 0.1-0.2 | 0.020 max | 0.01-0.10 | 0.05-0.12 | | | |
| N06045 | 2.5-3.0 | 0.010 max | | 0.020 max | | | | | 0.03-0.09 |
| N06603 | 0.5 max | 0.010 max | 0.01-025 | 0.020 max | 0.01-0.10 | 0.01-0.15 | | | |
| N06696 | 1.0-2.5 | 0.010 max | 1.0 max | | | | | | |

TABLE 2a

Composition of the studied alloys, Part 1. All information in mass-%

| Alloy | Batch | C | S | N | Cr | Ni | Mn | Si | Ti | Fe | P | Al | Zr | Y | Hf | 7,7C-x · a | PN |
|---|---|---|---|---|---|---|---|---|---|---|---|---|---|---|---|---|---|
| N06025 | 163968 | 0.170 | 0.002 | 0.023 | 25.4 | 62.1 | 0.07 | 0.07 | 0.13 | 9.5 | 0.008 | 2.25 | 0.08 | 0.08 | — | 1.192 | 0.0235 |
| N06025 | 160483 | 0.172 | <0.002 | 0.025 | 25.7 | 62.0 | 0.06 | 0.05 | 0.14 | 9.4 | 0.007 | 2.17 | 0.09 | 0.07 | — | 1.196 | 0.0256 |
| E | 126251 | 0.075 | 0.003 | 0.023 | 25.3 | 62.0 | 0.02 | 0.05 | 0.18 | 9.8 | 0.003 | 2.27 | 0.06 | 0.07 | <0.01 | 0.424 | 0.0334 |
| N06601 | 314975 | 0.045 | <0.002 | 0.011 | 23.1 | 59.3 | 0.58 | 0.34 | 0.47 | 14.6 | 0.007 | 1.33 | 0.02 | — | — | −0.101 | 0.1105 |
| N06601 | 156656 | 0.053 | 0.002 | 0.018 | 23.0 | 59.6 | 0.72 | 0.24 | 0.47 | 14.4 | 0.008 | 1.34 | 0.02 | — | — | −0.015 | 0.1045 |
| N06601 | 156125 | 0.052 | 0.002 | 0.017 | 23 | 60.2 | 0.58 | 0.38 | 0.45 | 13.2 | 0.009 | 1.30 | 0.02 | — | — | −0.007 | 0.100 |

TABLE 2b

Composition of the studied alloys, Part 2. All information in mass-%

| Alloy | Batch | Mo | Nb | Cu | Mg | Ca | V | W | Co | La | B | Ta | Ce | O |
|---|---|---|---|---|---|---|---|---|---|---|---|---|---|---|
| N06025 | 163968 | 0.01 | <0.01 | 0.01 | 0.011 | 0.002 | 0.03 | — | 0.05 | — | 0.005 | — | — | 0.0009 |
| N06025 | 160483 | 0.02 | 0.01 | 0.01 | 0.01 | 0.002 | — | — | 0.04 | — | 0.003 | — | — | — |
| E | 126251 | <0.01 | <0.01 | 0.01 | 0.013 | 0.002 | <0.01 | <0.01 | 0.04 | <0.01 | 0.003 | <0.01 | <0.01 | 0.0013 |
| N06601 | 314975 | 0.03 | 0.02 | 0.04 | <0.001 | <0.01 | 0.04 | <0.01 | 0.03 | — | 0.002 | — | 0 | 0.0006 |
| N06601 | 156656 | 0.04 | 0.01 | 0.04 | 0.012 | <0.01 | 0.03 | 0.01 | 0.04 | — | 0.001 | — | 0 | 0.0001 |
| N06601 | 156125 | 0.02 | 0.06 | 0.01 | 0.015 | <0.01 | 0.03 | — | 0.04 | — | — | — | — | — |

TABLE 3

Results of the tensile tests at room temperature. The forming speed was 8.33 $10^{-5}$ 1/s (0.5%/min) at $R_{p0.2}$ and 8.33 $10^{-4}$ 1/s (5%/min) at $R_m$

| Alloy | Batch | 7,7C-x · a | PN | Grain size in μm | $R_{p02}$ in MPa | $R_m$ in MPa | $A_5$ in % |
|---|---|---|---|---|---|---|---|
| N06025 | 163968 | 1.192 | 0.0235 | 75 | 287 | 686 | 41 |
| N06025 | 160483 | 1.196 | 0.0256 | 76 | 340 | 721 | 43 |
| E | 126251 | 0.424 | 0.0334 | 121 | 251 | 675 | 80 |
| N06601 | 314975 | −0.101 | 0.1105 | 114 | 232 | 644 | 56 |
| N06601 | 156656 | −0.015 | 0.1045 | 136 | 238 | 645 | 53 |

TABLE 4

Results of the MVT tests.

| Alloy | Batch | Welding gas | Total crack length in mm | | DDC cracks in mm | |
|---|---|---|---|---|---|---|
| | | | 1% bending elongation | 4% bending elongation | 1% bending elongation | 4% bending elongation |
| N06025 | 163968 | Ar | 27 | 35 | 0 | 0 |
| N06025 | 163968 | Ar3% N | 0 | 3.5 | 0 | 0 |
| E | 126251 | Ar | 23 | 34 | 0.1 | 0 |
| E | 126251 | Ar3% N | 1.6 | 15 | 2 | 0.2 |
| N06601 | 314975 | Ar | 0.3 | 9.2 | 0 | 0.4 |
| N06601 | 314975 | Ar3% N | 6 | 13 | 0 | 1.4 |
| N06601 | 156656 | Ar | 1.9 | 10 | 0.2 | 0 |
| N06601 | 156656 | Ar3% N | 2.6 | 18 | 1.5 | 0 |

TABLE 5

Results of the hot tensile tests. The forming speed was 8.33 $10^{-5}$ 1/s (0.5%/min) at $R_{p0.2}$ and 8.33 $10^{-4}$ 1/s (5%/min) at $R_m$

| | Alloy | N06025 | E | N06601 | N06601 |
|---|---|---|---|---|---|
| | Batch | 163968 | 126251 | 314975 | 156656 |
| | Designation IfW | tVL | tVM | tVH | tVK |
| T in ° C. | Grain size μm | 75 | 121 | 114 | 136 |
| 600 | $R_{p02}$ in MPA | 219 | 170 | 151 | 154 |
| 700 | $R_{p02}$ in MPA | 292 | 267 | 266 | 227 |
| 800 | $R_{p02}$ in MPA | 222 | 249 | 201 | 161 |
| 900 | $R_{p02}$ in MPA | 85 | 77 | 72 | 76 |
| 1100 | $R_{p02}$ in MPA | 33 | 26 | 25 | 29 |
| 600 | $R_m$ in MPA | 556 | 526 | 508 | 509 |
| 700 | $R_m$ in MPA | 530 | 506 | 500 | 466 |
| 800 | $R_m$ in MPA | 299 | 303 | 266 | 239 |
| 900 | $R_m$ in MPA | 136 | 127 | 119 | 121 |
| 1100 | $R_m$ in MPA | 51 | 45 | 43 | 46 |
| 600 | $A_5$ in % | 35 | 47 | 57 | 55 |
| 700 | $A_5$ in % | 30 | 31 | 56 | 36 |
| 800 | $A_5$ in % | 57 | 58 | 113 | 91 |
| 900 | $A_5$ in % | 82 | 108 | 136 | 98 |
| 1100 | $A_5$ in % | 68 | 83 | 152 | 92 |

TABLE 6

Results of the slow hot tensile test. The forming speed was 1.0 $10^{-6}$ 1/s (6.0 $10^{-3}$%/min) during the entire test. The test was stopped when an elongation of 33% and $R_m$ was reached.

| | Alloy | N06025 | E | N06601 |
|---|---|---|---|---|
| | Batch | 163968 | 126251 | 156656 |
| | Designation IfW | tVL | tVM | tVK |
| T in ° C. | Grain size μm | 75 | 121 | 136 |
| 700 | $R_{p02}$ in MPA | 337 | 274 | 243 |
| 800 | $R_{p02}$ in MPA | 139 | 142 | 89 |
| 1100 | $R_{p1}$ in MPA | 19 | 15 | 14 |
| 700 | $R_m$ in MPA | 358 | 358 | 288 |
| 800 | $R_m$ in MPA | 149 | 149 | 99 |
| 1100 | $R_m$ in MPA | 21 | 17 | 16 |
| 700 | $A_5$ in % | 15 | 13 | 17 |
| 800 | $A_5$ in % | 25 | 26 | >33 |
| 1100 | $A_5$ in % | >33 | >33 | >33 |

The invention claimed is:

1. Deep-drawn part comprising a nickel-chromium-aluminum-iron alloy, wherein the deep-drawn part is produced from a strip, a wire, or a sheet comprising the alloy, and wherein the alloy has (in wt.-%) 12 to 28% chromium, 1.8 to 3.0% aluminum, 1.0 to 15% iron, 0.01 to 0.5% silicon, 0.005 to 0.5% manganese, 0.01 to 0.20% yttrium, 0.02 to 0.60% titanium, 0.01 to 0.2% zirconium, 0.0002 to 0.05% magnesium, 0.0001 to 0.05% calcium, 0.03 to 0.11% carbon, 0.003 to 0.05% nitrogen, 0.0005 to 0.008% boron, 0.0001-0.1010% oxygen, 0.001 to 0.030% phosphorus, max. 0.010% sulfur, max. 0.5% molybdenum, max. 0.5% tungsten, remainder nickel and the usual process-related contaminants, wherein the following relationships must be fulfilled:

$$0<7.7C-x\cdot a<1.0 \quad (2)$$

$$\text{with } a=PN, \text{ if } PN>0 \quad (3a)$$

$$\text{or } a=0, \text{ if } PN\leq 0 \quad (3b)$$

$$\text{and } x=(1.0Ti+1.06Zr)/(0.251Ti+0.132Zr) \quad (3c)$$

$$\text{where } PN=0.251Ti+0.132Zr-0.857N \quad (4)$$

and Ti, Zr, N, C are the concentration of the related elements in mass-%.

2. Deep-drawn part according to claim 1, wherein the alloy has a chromium content of 16 to 28%.

3. Deep-drawn part according to claim 1, wherein the alloy has a chromium content of 20 to 28%.

4. Deep-drawn part according to claim 1, wherein the alloy has an aluminum content of 1.9 to 2.9%.

5. Deep-drawn part according to claim 1, wherein the alloy has an iron content of 1.0 to 11.0%.

6. Deep-drawn part according to claim 1, wherein the alloy has a silicon content of 0.01-0.2%.

7. Deep-drawn part according to claim 1, wherein the alloy has a manganese content of 0.005 to 0.20%.

8. Deep-drawn part according to claim 1, wherein the alloy has an yttrium content of 0.01 to <0.045%.

9. Deep-drawn part according to claim 1, wherein yttrium is completely or partially replaced in the alloy by 0.001 to 0.2% lanthanum and/or by 0.001 to 0.2% cerium.

10. Deep-drawn part according to claim 1, wherein titanium is completely or partially replaced in the alloy by 0.001 to 0.6% niobium.

11. Deep-drawn part according to claim 1, wherein zirconium is completely or partially substituted in the alloy by 0.001 to 0.2% hafnium and the formulas 3c and 4 are replaced by the following formulas:

$$x=(1.0Ti+1.06Zr+0.605Hf)/(0.251*Ti+0.132Zr+0.0672Hf) \quad (3c\text{-}1)$$

$$\text{where } PN=0.251Ti+0.132Zr+0.0672Hf-0.857N \quad (4\text{-}1)$$

and Ti, Zr, Hf, N, C are the concentration of the elements in question in mass-%.

12. Deep-drawn part according to claim 1, wherein the alloy has a magnesium content of 0.0005 to 0.03%.

13. Deep-drawn part according to claim 1, wherein the alloy has a calcium content of 0.0005 to 0.02%.

14. Deep-drawn part according to claim 1, wherein the alloy has a carbon content of 0.04 to 0.10%.

15. Deep-drawn part according to claim 1, wherein the alloy has a nitrogen content of 0.005 to 0.04%.

16. Deep-drawn part according to claim 1, wherein the alloy furthermore contains up to 5.0% Co.

17. Deep-drawn part according to claim 1, wherein the alloy furthermore contains maximally 0.1% vanadium.

18. Deep-drawn part according to claim 1, wherein the contaminants in the alloy are adjusted in contents of max. 0.5% Cu, max. 0.002% Pb, max. 0.002% Zn, max. 0.002% Sn.

19. Deep-drawn part according to claim 1, wherein the alloy has a max. molybdenum content of 0.20% and a max. tungsten content of 0.20%.

20. Object comprising a nickel-chromium-aluminum-iron alloy, wherein the object is selected from the group consisting of a mantle for glow plugs, an exhaust gas system component, and a catalytic converter support foil, and wherein the alloy has (in wt.-%) 12 to 28% chromium, 1.8 to 3.0% aluminum, 1.0 to 15% iron, 0.01 to 0.5% silicon, 0.005 to 0.5% manganese, 0.01 to 0.20% yttrium, 0.02 to 0.60% titanium, 0.01 to 0.2% zirconium, 0.0002 to 0.05% magnesium, 0.0001 to 0.05% calcium, 0.03 to 0.11% carbon, 0.003 to 0.05% nitrogen, 0.0005 to 0.008% boron, 0.0001-0.1010% oxygen, 0.001 to 0.030% phosphorus, max. 0.010% sulfur, max. 0.5% molybdenum, max. 0.5% tungsten, remainder nickel and the usual process-related contaminants, wherein the following relationships must be fulfilled:

$$0<7.7C-x\cdot a<1.0 \quad (2)$$

$$\text{with } a=PN, \text{ if } PN>0 \quad (3a)$$

$$\text{or } a=0, \text{ if } PN\leq 0 \quad (3b)$$

$$\text{and } x=(1.0Ti+1.06Zr)/(0.251Ti+0.132Zr) \quad (3c)$$

$$\text{where } PN=0.251Ti+0.132Zr-0.857N \quad (4)$$

and Ti, Zr, N, C are the concentration of the related elements in mass-%.

* * * * *